US012644633B2

(12) United States Patent
Cramer

(10) Patent No.: US 12,644,633 B2
(45) Date of Patent: Jun. 2, 2026

(54) SYSTEM FOR HIGH EFFICIENCY PORTABLE AIR COOLING

(71) Applicant: Ryan Christopher Cramer, Atlanta, GA (US)

(72) Inventor: Ryan Christopher Cramer, Atlanta, GA (US)

( * ) Notice: Subject to any disclaimer, the term of this patent is extended or adjusted under 35 U.S.C. 154(b) by 160 days.

(21) Appl. No.: 17/527,329

(22) Filed: Nov. 16, 2021

(65) Prior Publication Data

US 2023/0152021 A1 May 18, 2023

(51) Int. Cl.
*F25D 11/00* (2006.01)

(52) U.S. Cl.
CPC ..... *F25D 11/003* (2013.01)

(58) Field of Classification Search
CPC ..... F25D 11/003; F25D 3/08; F24F 5/0017
See application file for complete search history.

(56) References Cited

U.S. PATENT DOCUMENTS

| | | | | |
|---|---|---|---|---|
| 4,656,840 | A | 4/1987 | Loofbourrow et al. | |
| 5,046,329 | A * | 9/1991 | Travis, III | F25D 3/08 62/406 |
| 5,806,338 | A | 9/1998 | Schwartz et al. | |
| 6,409,206 | B1 | 6/2002 | Willrich | |
| 6,481,213 | B2 | 11/2002 | Carr et al. | |
| 6,503,063 | B1 | 1/2003 | Brunsell | |
| 6,571,568 | B1 | 6/2003 | Link | |
| 7,188,489 | B2 | 3/2007 | Martello | |
| 7,246,505 | B2 | 7/2007 | Navedo et al. | |
| 7,886,548 | B1 | 2/2011 | Graves | |
| 9,091,449 | B2 | 7/2015 | Donaldson et al. | |
| 9,452,769 | B1 | 9/2016 | Williams et al. | |
| 10,845,065 | B1 | 11/2020 | Rosario | |
| 2004/0011073 | A1 | 1/2004 | Blackstone | |
| 2007/0000277 | A1 | 1/2007 | Bratcher | |

(Continued)

FOREIGN PATENT DOCUMENTS

| | | | |
|---|---|---|---|
| DE | 102016002438 A1 | 2/2016 | |
| GB | 2282661 B | 12/1993 | |
| WO | WO-2005081675 A2 * | 9/2005 | F24F 1/04 |

OTHER PUBLICATIONS

S. Liu & M. Sakr, A Comprehensive Review on Passive Heat Transfer Enhancements in Pipe Exchangers, 19 Renewable and Sustainable Energy Reviews 64 (2013).

(Continued)

*Primary Examiner* — Jerry-Daryl Fletcher
*Assistant Examiner* — Keith Stanley Myers
(74) *Attorney, Agent, or Firm* — Jacob W. Neu; Lucas R. Yordy; Bradley Arant Boult Cummings LLP

(57) ABSTRACT

A portable cooling apparatus or air conditioner for high efficiency air cooling. The apparatus has a case defining an interior volume. The interior volume contains a cooling substance such as cold water or ice, an intake port, and an exit port. A pathway is defined between the intake port and the exit port for air to pass through the case. The pathway may be defined by a pipe. Alternatively the cooling substance may be contained within one or more containers insertable into the case and that define a pathway between the sides of the containers. A fan with a power source is provided to drive air through the case and pathway. The air is cooled by heat transfer with the cooling substance.

19 Claims, 7 Drawing Sheets

(56) References Cited

U.S. PATENT DOCUMENTS

| | | | | |
|---|---|---|---|---|
| 2007/0180840 | A1* | 8/2007 | Shostack | F28F 1/42 62/186 |
| 2017/0223922 | A1 | 8/2017 | Loopesko | |
| 2018/0356143 | A1 | 12/2018 | Weber | |
| 2019/0093909 | A1* | 3/2019 | Floyd | A45C 11/20 |
| 2020/0173669 | A1 | 6/2020 | Sophus | |
| 2021/0338510 | A1* | 11/2021 | Augustine | A61G 13/108 |

OTHER PUBLICATIONS

Naga Sarada S., Kalyani K. Radha, & A. V. S. Raju, Experimental Investigations in a Circular Tube to Enhance Turbulent Heat Transfer Using Mesh Inserts, APRN Journal of Engineering and Applied Sciences, Jul. 2009, at 53.

* cited by examiner

SYSTEM FOR HIGH EFFICIENCY PORTABLE AIR COOLING

FIELD OF THE INVENTION

The disclosure relates to a novel application of high efficiency heat transfer technology to provide portable and energy efficient cooling of air, useful in applications requiring portable personal cooling such as a child's stroller and other applications.

BACKGROUND

Conventional portable coolers rely on battery-powered fans. While these devices provide some cooling capability, such devices are limited in that they move air of the ambient temperature. Portable, battery-powered air conditioners that rely on compressors and refrigerant also exist, although these devices are too large for many portable applications, and their energy consumption and mechanical complexity make them cost prohibitive for many ordinary consumer-level applications. Similar devices based on Peltier modules also exist, although in a construction that provides sufficient cooling these Peltier based devices tend to be too large, have high energy consumption rates, and are generally cost prohibitive for many ordinary consumer-level applications.

Portable air coolers that rely on evaporative cooling also exist. However, these devices are generally limited in the amount of cooling effect they can generate from evaporation alone, and due to the nature of evaporative cooling, are limited in the amount of airflow they can generate. Because evaporative cooling relies on evaporation as its method of heat transfer, a system based on evaporative cooling is less effective in situations that include high ambient humidity as is often the case when portable cooling is needed: outdoor situations in hot, high humidity climates.

Air coolers exist that rely on ice or some other cooled substance for their heat transfer, and these devices are generally more portable and can be produced at a cost more appropriate for ordinary consumer-level applications. These devices typically use a direct current (DC) battery-powered fan to blow air through an insulated chamber holding ice, transferring the heat existing in the ambient air directly to the ice, after which colder air exits the chamber and can be blown on the object or area to be cooled. However, a trade-off typically exists in these devices between relatively large devices that exhibit sufficient air cooling capabilities (but which devices are too large to realistically transport without a mechanically-powered vehicle), versus more portable devices that exhibit substantially less air cooling capabilities due to a relatively small amount of cooling material used and an inefficient means of heat transfer, as well as relatively low air flow due to the use of small, low-powered fans. These limitations of current devices substantially diminish their usefulness in certain air cooling capacities, such as those where the air cooling device must be transported by hand or otherwise with a non-mechanically-powered vehicle, or where a device must exhibit sufficient cooling capacity and air flow to move cool air more than two feet through a tube to the area or object to be cooled for moderate durations of time.

Therefore, techniques that overcome the above disadvantages are desired.

BRIEF DESCRIPTION OF THE INVENTION

In some respects the invention disclosed herein is a cooling apparatus having a case having walls defining an interior volume, a cover removable to access the interior volume, and an intake port and an exit port located on the walls or cover; a plurality of containers adapted to substantially fill the interior volume of the case, the plurality of containers configured to define a path from the intake port to the exit port, wherein each container is configured to receive a cooling substance; a fan configured to blow air through the intake port, the path, and the exit port; and a power source for the fan.

In other respects the invention disclosed herein is a cooling apparatus having a case having walls defining an interior volume, a cover removable to access the interior volume, and an intake port and an exit port located on the walls or cover; a thermally conductive pipe within the interior volume having a first end connected to the intake port and a second end connected to the exit port; a fan configured to blow air through the intake port, the pipe, and the exit port; and a power source for the fan, wherein the interior volume surrounding the pipe contains a cooling substance.

DETAILED DESCRIPTION OF THE INVENTION

The disclosure herein generally relates to an apparatus that may deliver cold (or at least cooler than ambient) air to one or more locations. Advantageously, embodiments of the apparatus may be used in relatively small spaces such as baby strollers, children's play pens, cribs and other items and areas that may be used by one or more children. Small spaces in which embodiments of the apparatus may be used may relate to adult activities include a hunting blind, a camping tent, a cab of a truck or interior of another vehicle, a fishing shack, etc. Another advantage of the apparatus is that it may be scaled up to be used in venues that are larger than those mentioned previously.

Figure 1:
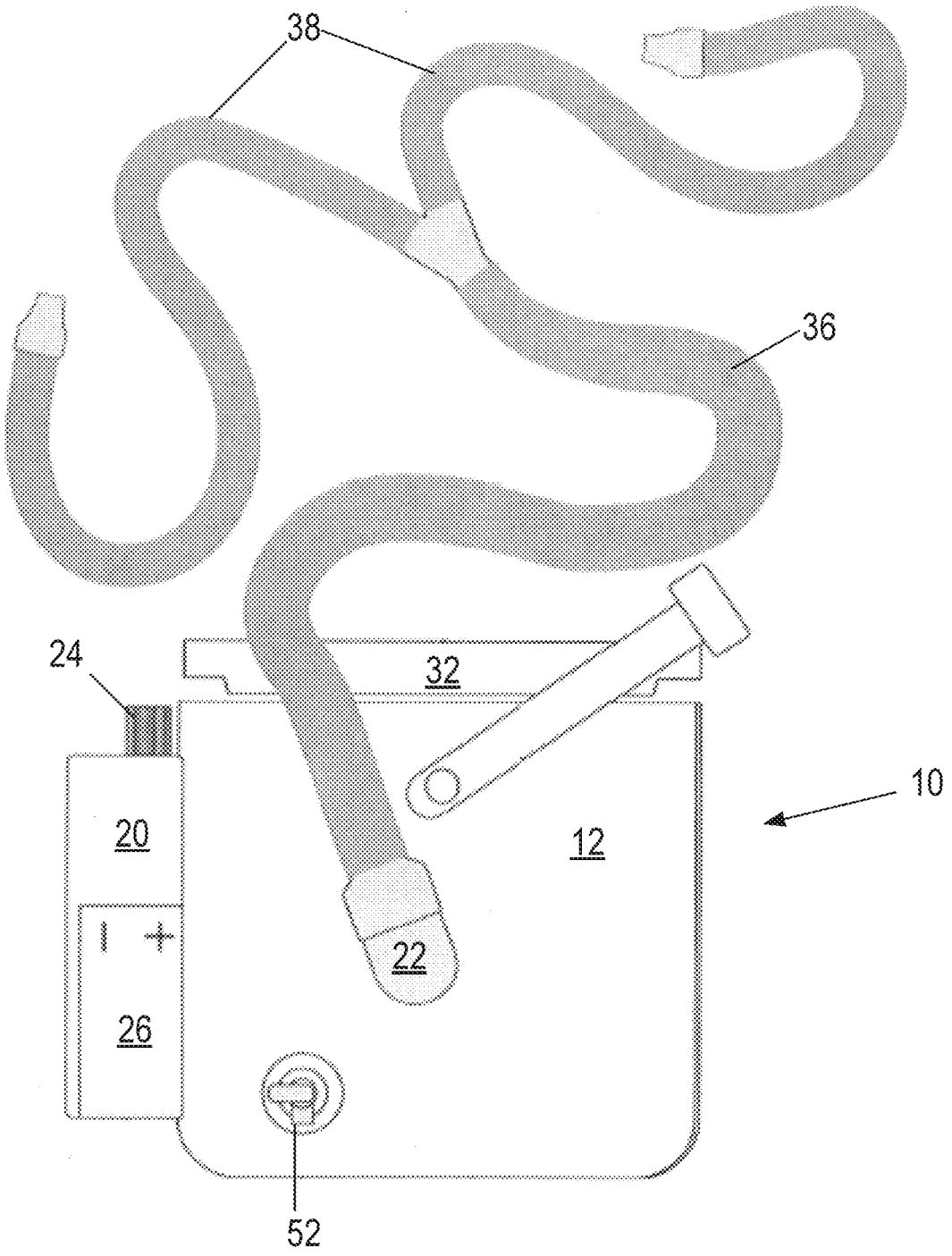
FIG. 1 depicts an exterior view of an embodiment of the apparatus disclosed herein.
Figure 2:
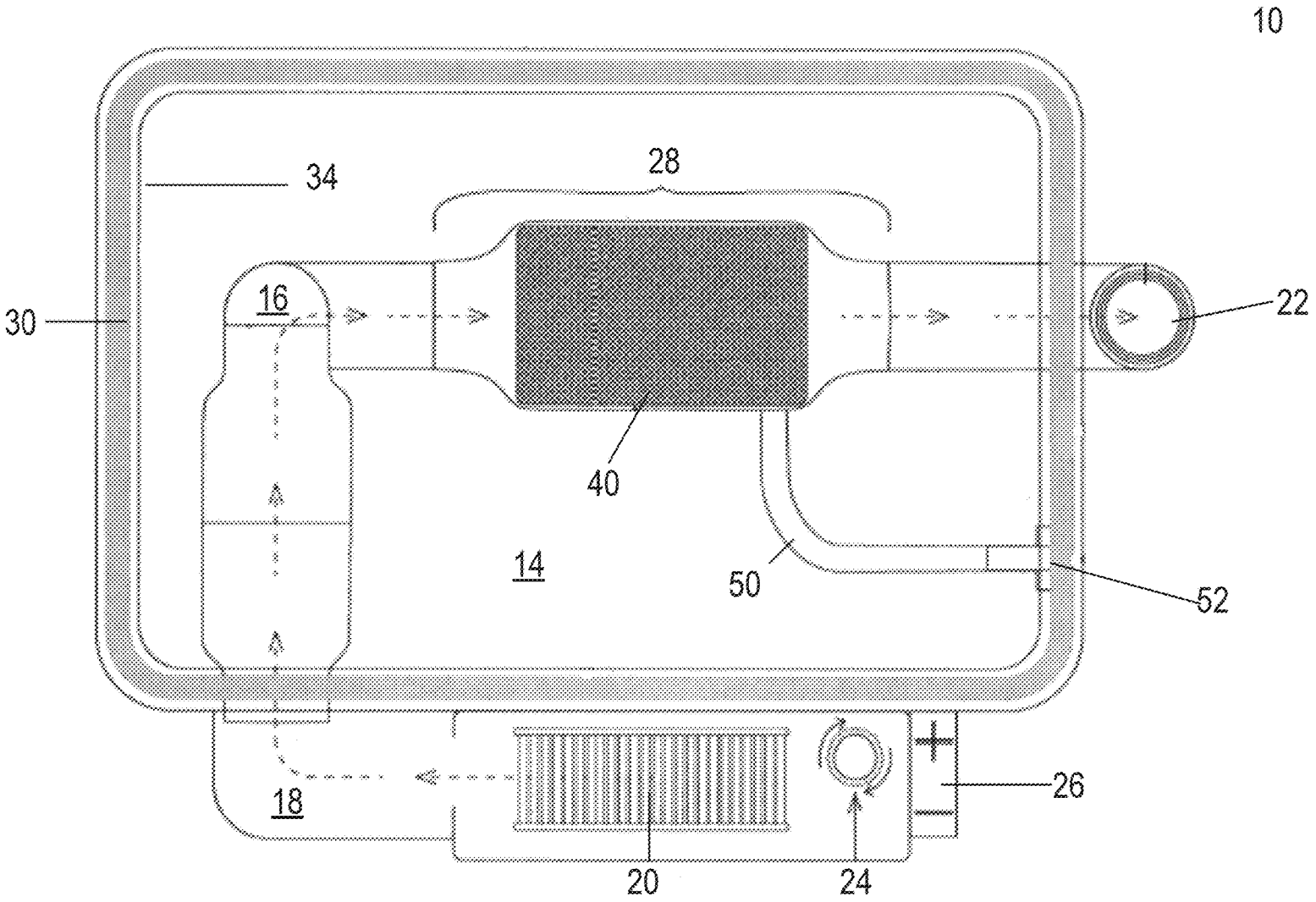
FIG. 2 depicts a top view of an interior of the case of an embodiment of the apparatus disclosed herein.
Figure 3:
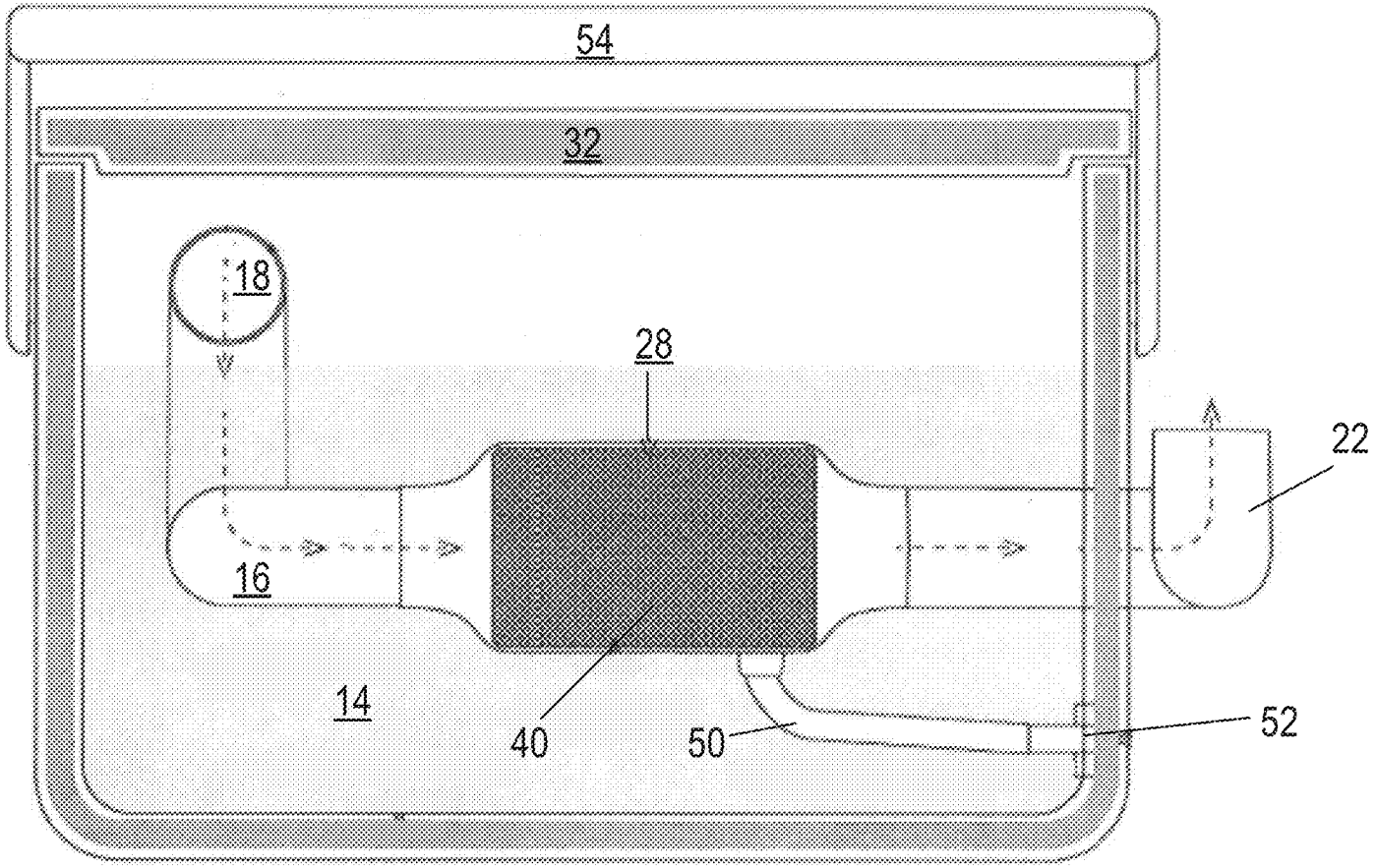
FIG. 3 depicts a side cross-sectional view of the interior of the case of an embodiment of the apparatus disclosed herein.

In a first embodiment, such as depicted in FIGS. 1-3, a case or housing 12 is provided. The case 12 may hold or contain a cooling substance 14 that may interact with a pipe system 16 to cool air that is pushed through the pipe system by a fan exterior to the case 12. More particularly, an intake pipe 18 disposed through an opening in the case 12 may receive air of ambient temperature from a fan 20 on the outside of the case 12. The intake pipe 18 may be part of a pipe system 16 disposed within the housing 12 that allows for air moving from the intake pipe 18 through the housing 12. The housing 12 may further enclose a heat transfer module for allowing heat transfer from the air to a cooled agent within the housing 12. A further pipe connects to an exit port 22 through which the air exits to be distributed via one or more hoses as may be selected by the user.

In other embodiments the apparatus may include a case 12 for containing various elements for providing cooled air. The case 12 may be of any appropriate size and shape. In some embodiments the case 12 may be generally rectangularly shaped, of a similar size and shape to a briefcase or small suitcase. The case 12 may be made of any material, preferably lightweight, commonly-used in the construction of consumer-level goods, such as plastic, stainless steel, aluminum, carbon fiber, or other similar substance. The walls 34 of the case 12 may be insulated to assist in keeping the interior of the case 12 cool For example, the cooling apparatus should remain cool during use (i.e., when a fan is actually blowing to provide cool air), and should maintain the temperature of the interior of the case when not in use (e.g., during transport or otherwise during period when not blowing air). For example, the case 12 may be double walled and may include a layer of insulating material 30 between the interior and exterior walls of the case 12. Such insulating material may include one or more substances that may exhibit low thermal conductivity, such as extruded polystyrene foam, expanded polystyrene foam, polyurethane foam, a vacuum chamber, cellulose, fiberglass, or other such material. The case 12 may include a cover 32, such as a lid or cap, or other removable top or side for allowing a user to gain entry into the interior of the case 12. The cover also may be insulated. Further, a handle 54 may be provided for carrying and transporting the embodiment. An ice chest (e.g., as a cooler, an icebox, or a cold-storage box) is an example of a case 12 as may be used in the apparatus.

The case 12 may be of sufficient size to hold an adequate amount of fluid, ice, cold packs, or other cooling substance 14 (for example: four quarts) while its overall size may be of a size that is portable by hand or through non-mechanically-powered vehicle means (e.g., smaller than a cubic foot).

The case 12 may be used to hold a fluid or solid cooling substance 14. A cooling substance as used herein is a substance having the capability to maintain a cold temperature while absorbing relatively large amounts of heat, that is, the material has a high specific heat capacity. Such cooling substance 14 may include water, ice, sodium polyacrylate, hydroxyethyl cellulose, silica gel, or other similar substance. For example, ice at −10° C. has an isobaric mass specific heat capacity of 2.05 J/(g·K). Liquid water has a specific heat capacity of 4.18 J/(g·K). Preferably, specific heat capacity of the cooling substance 14 would exceed at least that of air (~1 J/(g·K)). Depending on the properties of the cooling substance 14, the cooling substance may be placed directly into the case 12 or it may be enclosed in a separate container that may then be placed into the case 12. Since the case 12 may hold fluids, the interior of the case 12 may be sealed such that fluids do not leak from the case 12. Prior to use of this device, the cooling substance 14 may be cooled to extent possible, preferably below 32 degrees Fahrenheit. Depending on the properties of the cooling substance 14 used, such substance may be frozen solid inside of the case 12 by placing the entire device inside of a cold chamber, such as a refrigerator or freezer that is commonly found inside residences and businesses.

In some embodiments, the case 12 may be provided with an opening in a wall 34. An open end of a pipe may protrude through the opening in the wall 34 of the case 12, and that continues into the interior of the case 12. The open end of the pipe protruding through the opening in the case 12 and at least a part of the pipe closest to the open end may be referred to as the "intake" of the embodiment.

In the exterior of the case 12, a fan 20 may drive air of ambient temperature into the intake of the apparatus. Advantageously, the fan 20 may have an on/off switch. Also, the fan 20 may be adjusted in its speed by the use of a potentiometer 24 (and/or any other method or device). The on/off function and the speed of the fan 20 may be controlled by an input or control of the embodiment. The fan 20 may be powered in any appropriate manner. In one embodiment, the fan 20 is powered by a battery 26.

More specifically, some embodiments may use a fan 20 (such as an electric fan) of sufficient air flow and pressure (at least 25 cubic feet per minute and 700 Pascals) that air may be pushed through a one inch of pipe or hose at least three feet in length and still maintain sufficient air flow. The preferred embodiment may include a radial fan, although an axial fan may also be used. Such fan 20 may also be of a size that does not unduly contribute to the device's overall size or weight, for example, less than 8 ounces in weight, and its dimensions being such that the entire fan 20 may fit within the exterior dimensional boundaries of the case 12.

In an alternative embodiment, the fan 20 may be attached to the exterior of the case 12.

As yet another alternative, the walls 34 of the case 12 may be constructed such that the fan 20 and intake do not protrude outside of the exterior surface of the wall 34 of the case 12.

In some embodiments, a single battery 26 of sufficient electrical output based on the specifications of the fan 20, with sufficient electrical storage capacity, may be used to power the fan 20. An alternative power source may be used to power the fan 20, or the fan 20 may have one or more back up power sources such as an additional battery 26, an electrical cord for connection to external power source, inductive charging or power supply, etc.

Some embodiments may include a power source(s) to fan the fan 20 at maximum speed for a minimum of two hours, at moderate speeds for a minimum of 4 hours, and would be rechargeable and removable from the case 12 in order to allow for the entire case 12 to be cooled prior to operation.

Some embodiments may include one or more elements to turn the fan 20 on and off and/or to control its speed. The one or more elements may include a switch, a potentiometer, and/or other device for moderating the flow of electricity between the battery 26 or power source and the fan 20 in such embodiments. Another element that may turn the fan 20 on and off, and may control the speed of the fan 20 may be a "smart device" such as a mobile telephone of the user, which may operate the embodiment through an application ("app") or application software that may communicate with a control unit for operating one or more elements of the embodiment.

Once the air is driven by the fan 20 into the intake of the embodiment, the air may continue through a pipe, which also may be referred to as tubing, in the interior of the housing 12. The pipe 16 may have sections to allow for the pipe to be disposed in the interior of the housing 12 from the intake to the heat transfer module 28 (as explained below) and to the output from the housing 12.

The pipe may be made of any appropriate material. For example, the pipe of the piping system may be made of copper, aluminum, plastic, or other material. The pipe may be coated to prevent oxidation, particularly if the interior of the case 12 is carrying water or ice.

The intake and connected piping are connected to one side of a heat transfer module 28, which may also be referred to as a heat transfer chamber. The heat transfer module 28, in some embodiments, is a slightly larger in diameter section of the pipe that runs through the interior of the housing 12. Other embodiments may vary. From the intake, the air moves through pipe and into the heat transfer module 28. The air moving through the interior of the housing 12 may be cooled throughout its movement, but especially in the heat transfer module 28.

Among the reasons that the air moving through the pipe system inside the case 12 is cooled more in the heat transfer module 28 than the remainder of the pipe system is that the heat transfer chamber may be made of a substance with high thermal conductivity. For example, some embodiments may include a heat transfer module 28 of copper due to its relatively high thermal conductivity and low cost. However, other material(s) exhibiting similar properties, such as aluminum, may be used separately, in combination, or in combination with copper. For purposes of this disclosure, a material is deemed to have "high thermal conductivity" if its thermal conductivity under atmospheric conditions and room temperature exceeds 10 W/(m·K).

In addition, the heat transfer chamber may contain a porous material 40. The porous material 40 may be constructed of one or more materials exhibiting high thermal conductivity that may increase the overall surface area inside of the heat transfer chamber. The porous material may be constructed of mesh, netting, a rough surface, coiled tubing, cones, a 3D printed porous structure, and/or some other structure(s) that may increase the surface area of the otherwise smooth interior walls of the heat transfer module 28. Porous material may be placed inside of the heat transfer module 28 to increase the efficiency of heat transfer while not restricting air flow. The increased overall surface area may increase the heat transfer rate of the heat transfer chamber. The moving air may cool more as it moves through the heat transfer chamber, rather than other elements of the apparatus, because of the air having to move through the porous material of the heat transfer chamber.

In some embodiments, the volume of the interior portion of the heat transfer chamber that encapsulates the porous material may be increased in order to facilitate heat transfer without restricting air flow. The facilitation of heat transfer without restricting air flow may be accomplished by either splitting the heat transfer chamber into two or more sections that rejoin one another prior to exiting the case 12, or by increasing the volume of the heat transfer chamber.

For optimal results the heat transfer chamber may be kept in direct physical contact with one or more of the cooling substances 14 to the maximum extent allowed by the design.

As the air moves through the heat transfer module 28 with the porous material and with the cooling of the air, moisture may accumulate within the heat transfer module 28. Advantageously, some embodiments may provide a condensation tube 50 that allows for the moisture to escape the heat transfer module 28. The condensation tube 50 may be set in the floor of the heat transfer module 28 so the moisture from within the heat transfer module 28 may fall to the floor and run off through the condensation tube 50. The opening to the condensation tube 50 may be set lower than the floor level of the heat transfer module 28 in the manner of a shower drain so that the condensation moves by gravity to the opening of the condensation tube. The condensation tube may be positioned below the heat transfer module 28 so that the condensation tube may deliver the collected moisture to a drain 52 in a lower part of the housing 12. For example, the drain 52 may be an opening in the lower part of a wall 34 of the housing 12. A condensation valve may allow the user to select when the collected moisture is to be drained from the apparatus.

Once the air that is moving within the exterior of the apparatus passes through the heat transfer module 28, the air may continue to cool as it moves through additional piping to the output of the air from the housing 12. The output may include an opening in the housing 12 through which an end of the interior pipe protrudes. The output also may be referred to as an exit port. Advantageously, the air exiting the housing 12 may be cooler than the air that entered the housing 12.

Advantageously, the user may direct the air exiting the housing 12 in one or more specific directions. The direction of the air exiting the housing 12 may be accomplished in any appropriate way. In some embodiments, the pipe protruding through the exit port 22 may be connected to a hose 36. The hose 36 may be flexible so the hose 36 may be configured so its end opposite to the exit port 22 connection is placed at or near where the user would like the air exiting the housing 12 to be delivered. The hose 36 may be insulated so the air exiting the housing 12 (presumably cooler than ambient air) does not leak or at least minimally leaks its coolness through the hose 36. In some embodiments, an air delivery system may include insulated hose 36 of at least 1 inch diameter and/or of sufficient length to transfer the cooled air to its intended location. The ideal length may be determined by the application.

Some embodiments allow for distribution of the presumably cooler air leaving the housing 12 according to the desires of the user. Some embodiments may be constructed such that the user can add or remove individual articulating hoses 38 or nozzles with different air diffusion properties depending on the application from the insulated hose 36 exiting from the exit port 22. For example, some embodiments may allow user to select two areas for the delivery of the cooled air. The embodiment may accomplish this dual delivery by the use of a pair of articulating hoses 38 that may be attached via a "Y" connection to the hose 36 connected to the exit port 22. Like the hose 36 connected to the exit port 22, the articulating hoses 38 may be insulated. The articulating hoses 38 may each have a nozzle at its respective end. Such a nozzle may focus the delivery the presumably cooler air from the housing 12 to a particular area as selected by the user.

Another way in which to vary delivery of the cooled air depending on the desire of the user is to use shorter, more rigid, longer, and/or less rigid hose or articulating hose. For example, shorter or more rigid hose may be used in order to decrease the amount of heat transfer that may occur within the hose, and thus, warming of the cool air. A shorter hose may also result in increased air flow. A longer hose could be used in situations where it is not practical to keep the device in close proximity to the object or area to be cooled.

Other embodiments, such as those depicted in FIGS. 4-7 may have a set of two or more containers 42 set within the housing 12. Together the containers 42 fill substantially all of the internal volume of the housing 12. That is, the containers are designed such that side surfaces of each container are proximate to an internal wall 34 of the housing 12 or to each other, with only a small gap 44 between the containers 42. A gasket or seal 46 is provided around the top of the containers to engage the cover. The cover 32 may engage the top of the containers to force air that is pumped into the interior of the housing 12 through the gaps.

The containers 42 may be tilled with ice, cold water, sodium polyacrylate, hydroxyethyl cellulose, silica gel, or other similar cooling substances 14. Prior to use of the apparatus by the user, the container and/or the cooling substance 14 may be cooled to extent possible, preferably below 32 degrees Fahrenheit. Depending on the properties of the cooling substance 14 used, such substance may be frozen solid inside of the case 12 by placing the entire device inside of a cold chamber, such as a refrigerator or freezer that is commonly found inside residences and businesses. The containers 42 are preferably made of a material having a high thermal conductivity (i.e., at least 10 W/(m·K) as defined above), such as copper or aluminum. Similar to the pipe described with respect to FIGS. 1-3, this decreases the temperature of the exterior of the containers and facilitates the heat transfer to cool the air.

Figure 4:
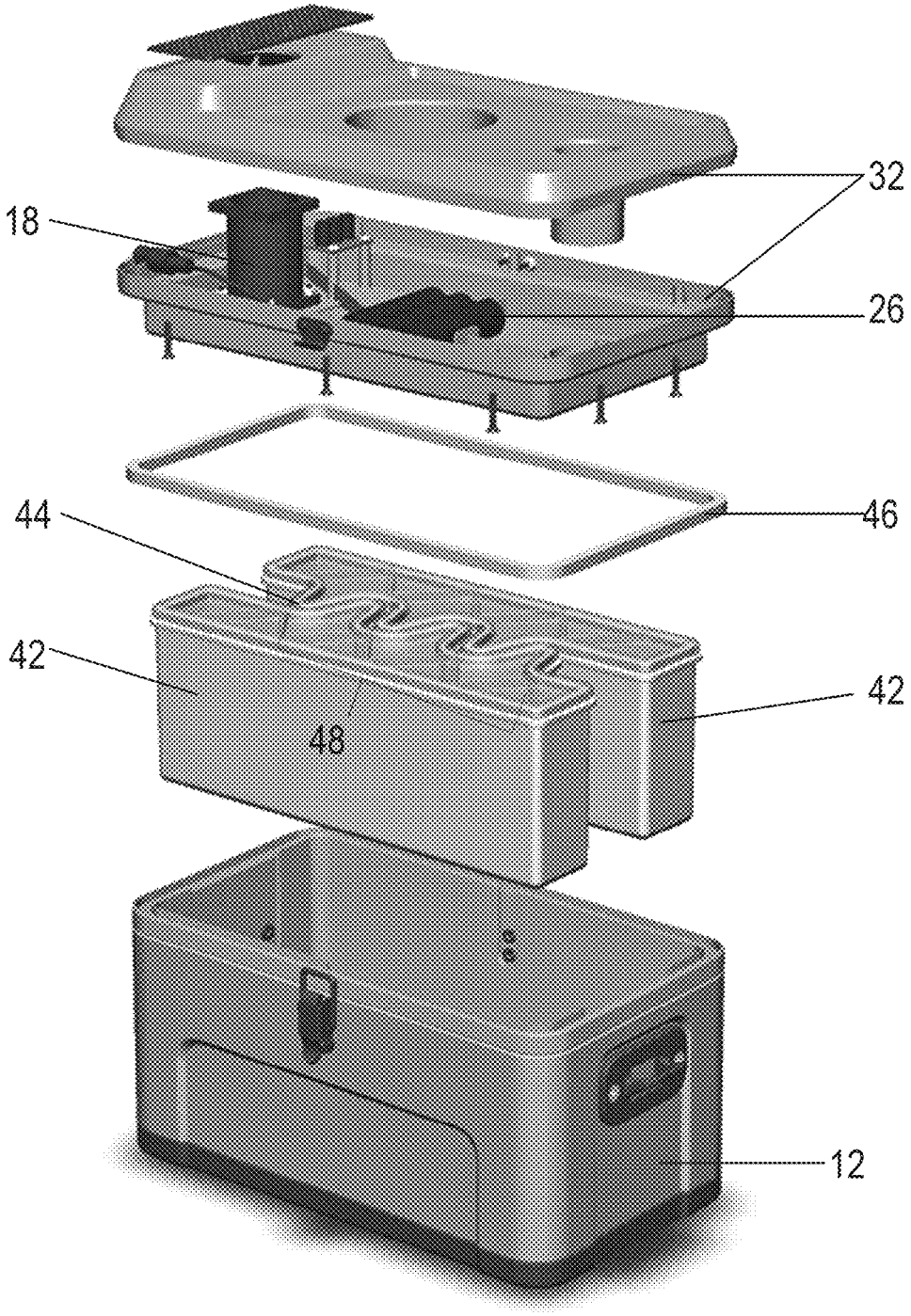
FIG. 4 depicts an exploded view of another embodiment of the apparatus disclosed herein.
Figure 5:
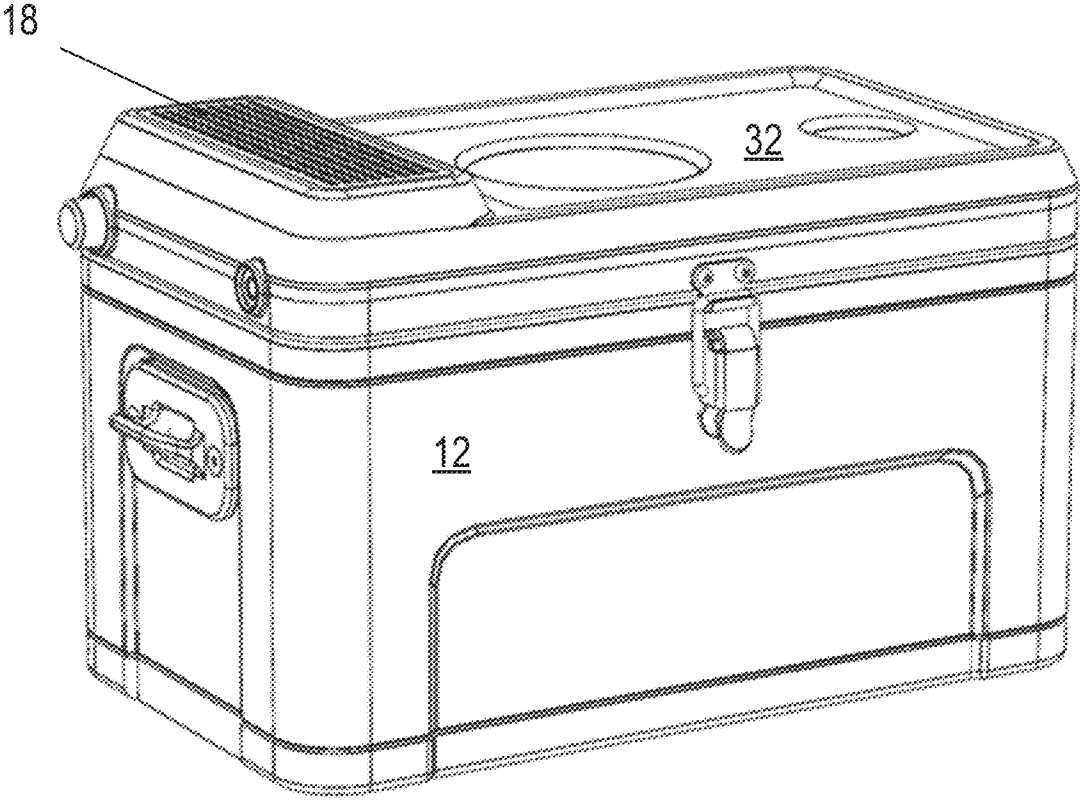
FIG. 5 depicts an exterior view of the case of another embodiment of the apparatus disclosed herein.
Figure 6:
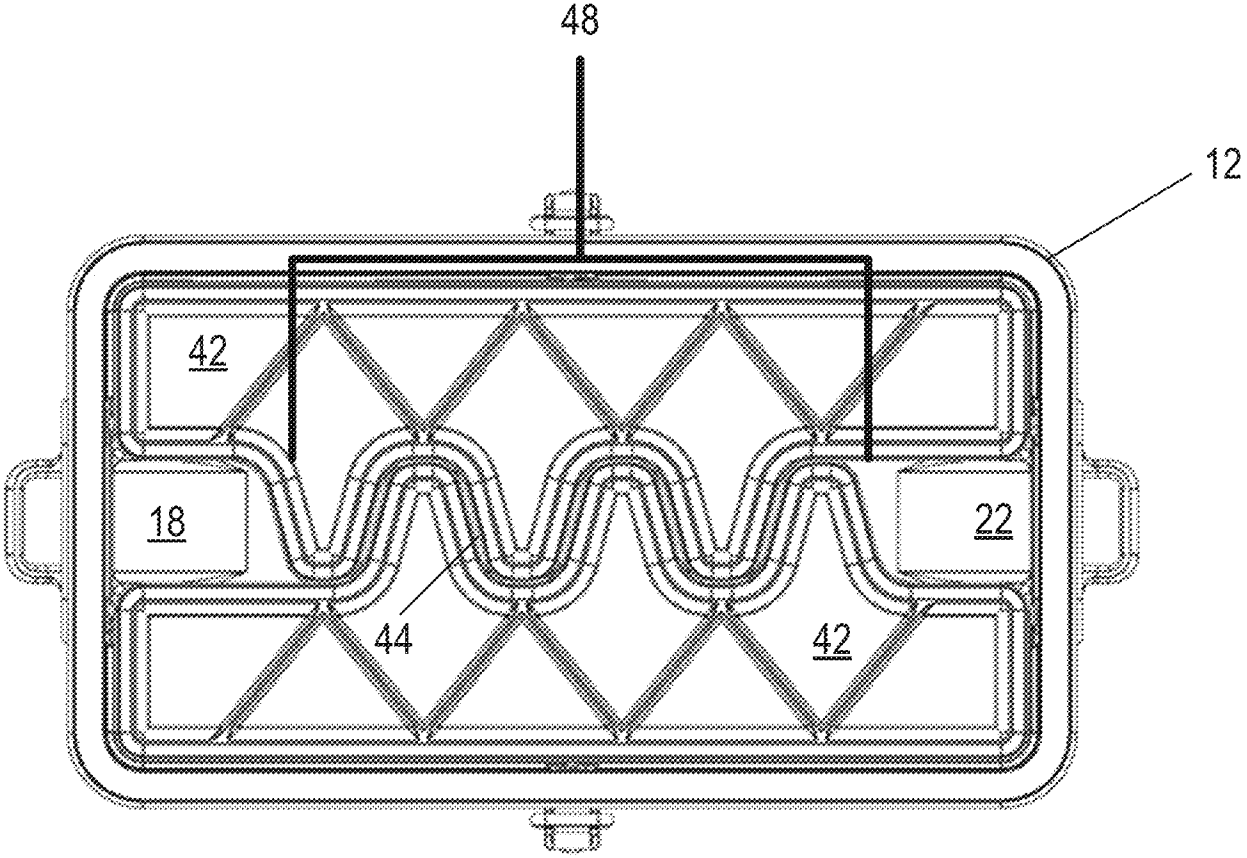
FIG. 6 depicts a top view of an interior of the case of another embodiment of the apparatus disclosed herein.

The containers 42 may be configured such that the gaps between the containers define one or more paths 48 between an area proximate to the intake port 18 and an area proximate to the exit port 22. In some embodiments the path 48 may go directly from the intake port region to the exit port region. In other embodiments, as shown in FIG. 4, the two containers 42 have an interlocking design, such that the path 48 curves back and forth. The air is directed into the path 48 between the containers, or alternatively, around the exterior of the containers between a container and the interior wall 34 of the housing 12.

Forcing the air through these narrow gaps 44 reduces the volume of air at a given location, thereby exposing more air directly against the cold container exterior surfaces. In addition, by taking a curving path from the intake port 18 to the exit port 22, the distance along the path is lengthened. This increases the amount of time air spends in the path, thereby increasing the cooling performance of the apparatus.

In the embodiment of FIGS. 4-7, no pipe is included in the interior of the housing 12. Therefore, the intake port 18 and the exit port 22 are separate pipes and only connect to the exterior of the housing 12 to permit air to flow into and out of the apparatus. Furthermore, the heat exchange occurs directly across the surface of the containers, and there is no separate heat transfer module. For these reasons, at least the surface of the container along the pathway should have a high thermal conductivity, as defined above.

The intake port 18 and exit port 22 may be located on the cover of the housing 12, as shown in FIG. 4. In the depicted embodiment, the fan 20, motor, intake port 18, exit port 22, and batteries 26 are positioned on or within the cover of the housing 12. This advantageously provides these elements at a single location on the housing 12 for repair or replacement.

Advantageously, some embodiments provide for releasably fastening the apparatus to a device or within an environment within which the embodiment may be used. For example, an embodiment may include attachment means to attach it to a stroller.

Figure 7:
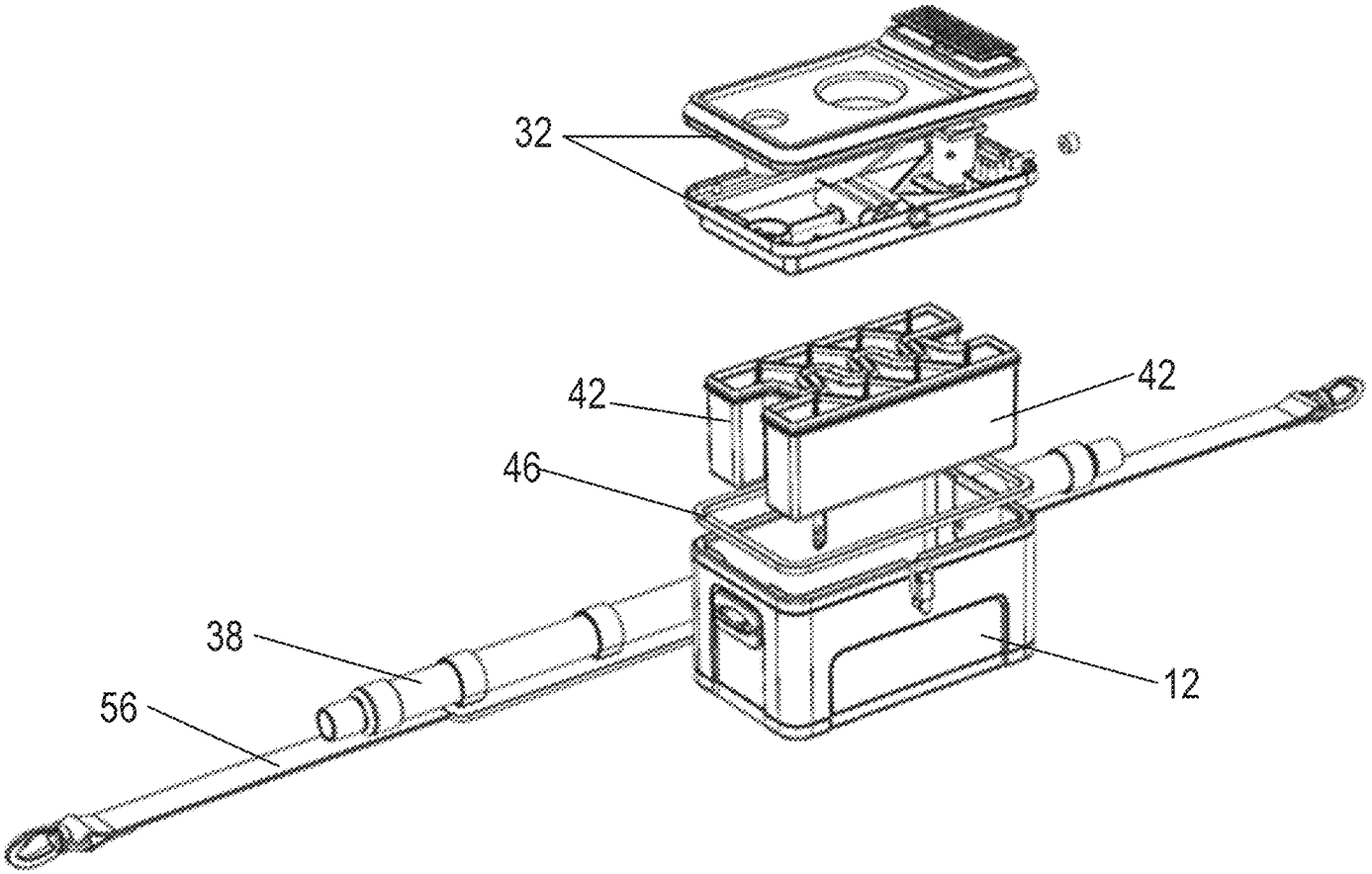
FIG. 7 depicts an exploded view of another embodiment of the apparatus as disclosed herein.

Another advantage is that one or more items may be added to an embodiment to increase its portability and convenience. A handle, strap, or wheels may be used to make an embodiment portable. Straps, clips, clamps, or hooks may be used to maintain the position of the case 12 and hose 38 in an embodiment. Furthermore, in some embodiments a strap 56 or end clips may be attached to the hose 38, such that the hose 38 may be clipped to the exterior of the case 12 to serve as a carrying strap. An example of such an embodiment is depicted in FIG. 7.

Yet another advantage relates to its heat transfer properties, The construction of the apparatus may allow for solid, frozen material below the temperature of 32 degrees Fahrenheit to completely encapsulate the heat transfer chamber. This may both maximize the amount of heat transfer and associated reduction in ambient air temperature, as well as maximize the duration of time the system may continue to absorb ambient heat from air. Its construction also may allow for a fan 20 and battery 26 of sufficient performance that relatively high air flow may be sustained for hours before recharging under a number of different air delivery system configurations.

In order to maximize the duration of fan 20 operation, solar panels or generators may be used to power the unit, charge the battery 26, or both.

This apparatus may be used in applications where the movement of ambient air is insufficient to maintain a desired temperature on a human body, animal body, or enclosed area, and where devices that employ mechanical cooling (e.g., refrigerant or Peltier modules) are impractical due to size, portability, performance, or cost. This system may cool air at a sufficient magnitude to make the apparent temperature noticeably lower than the ambient air, with sufficient power to allow the system to be placed at least several feet apart from the object or area to be cooled due to its ability to push cool air through a relatively long hose, while maintaining portability without the aid of a powered vehicle for transport. Furthermore, the high potential air flow affords a range of configurations for the air delivery system based on the desired application: a longer hose could be used for greater convenience, a shorter hose for increased air flow, or multiple articulating nozzles could be used to deliver air in different directions. Depending on the configuration, a low energy consumption rate may be used to maximize the duration of the battery's charge. Such applications where portable, high performance cooling of moderate duration is needed may include young children in strollers, camping, hunting, fishing, participation in or observation of sporting events, occupations that require one to remain outside, environmental or public health emergencies, pets or livestock, and alleviation of health issues that increase ones perceived or actual body temperature.

The apparatus may also be used to warm an object or area. This may be accomplished through placing a warm substance or fluid, or including an electric or other mechanical heating element, inside of the case 12. This heating may be accomplished through heat transfer from the warm substance or element inside the case 12 through the heat transfer chamber into the cold ambient air from outside of the case 12.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure.

The above description of preferred embodiments should not be interpreted in a limiting manner since other variations, modifications and refinements are possible within the spirit and scope of the present disclosure. The scope of the invention(s) is defined in the appended claims and their equivalents.

I claim:

1. A cooling apparatus comprising:

a) a case having walls defining an interior volume, a cover removable to access the interior volume, and an intake port and an exit port located on the walls or cover;

b) a plurality of containers adapted to substantially fill the interior volume of the case, the plurality of containers having side surfaces disposed adjacent to each other and defining a gap between the containers, the gap forming a continuous and winding path from the intake port to the exit port, wherein each container is configured to receive a cooling substance;

c) a fan configured to blow air through the intake port, the path, and the exit port; and d) a power source for the fan.

2. The cooling apparatus of claim 1, further comprising an exit hose connected to the exit port.

3. The cooling apparatus of claim 2, further comprising a plurality of articulating hoses connected to the exit hose.

4. The cooling apparatus of claim 1, wherein the number of containers is two.

5. The cooling apparatus of claim 1, wherein the power source is a battery.

6. The cooling apparatus of claim 1, further comprising a handle attached to the exterior of the case.

7. The cooling apparatus of claim 1, wherein each container comprises a path face along the path, wherein the path face has a thermal conductivity of at least 10 W (m·K).

8. The cooling apparatus of claim 1, wherein the cooling substance has a specific heat capacity of at least 2 J/(g·K).

9. The cooling apparatus of claim 2, wherein the exit hose is secured to a strap having detachable clips at each end, and wherein the housing further comprises rings for securing the detachable clips during transport.

10. A cooling apparatus comprising:

a) a case having walls defining an interior volume, a cover removable to access the interior volume, and an intake port and an exit port located on the walls or cover;

b) two containers adapted to substantially fill the interior volume of the case and having corresponding, corrugated side surfaces configured to parallel each other, the side surfaces defining a gap forming a curving path between the containers and between the intake port to the exit port;

c) a fan configured to blow air through the intake port, the path, and the exit port; and d) a power source for the fan.

11. The cooling apparatus of claim 10, further comprising an exit hose connected to the exit port.

12. The cooling apparatus of claim 11, further comprising a plurality of articulating hoses connected to the exit hose.

13. The cooling apparatus of claim 10, wherein the number of containers is two.

14. The cooling apparatus of claim 10, wherein the power source is a battery.

15. The cooling apparatus of claim 10, further comprising a handle attached to the exterior of the case.

16. The cooling apparatus of claim 10, wherein each container comprises a path face along the path, wherein the path face has a thermal conductivity of at least 10 W (m·K).

17. The cooling apparatus of claim 10, wherein the cooling substance has a specific heat capacity of at least 2 J/(g·K).

18. The cooling apparatus of claim 11, wherein the exit hose is secured to a strap having detachable clips at each end, and wherein the housing further comprises rings for securing the detachable clips during transport.

19. A cooling apparatus comprising:

a) a case having walls defining an interior volume, a cover removable to access the interior volume, and an intake port and an exit port located on the walls or cover;

b) a plurality of containers adapted to substantially fill the interior volume of the case, the plurality of containers shaped to be complimentary to and engage with each other and configured to define a winding path from the intake port to the exit port and extending continuously between the containers, wherein each container is configured to receive a cooling substance;

c) a fan configured to blow air through the intake port, the path, and the exit port; and d) a power source for the fan.

* * * * *